US010207513B2

(12) United States Patent
Ishii et al.

(10) Patent No.: US 10,207,513 B2
(45) Date of Patent: Feb. 19, 2019

(54) PRESSURE CONTROLLING APPARATUS AND LIQUID EJECTING APPARATUS

(71) Applicant: SEIKO EPSON CORPORATION, Tokyo (JP)

(72) Inventors: Hiroyuki Ishii, Shiojiri (JP); Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/346,256

(22) Filed: Nov. 8, 2016

(65) Prior Publication Data

US 2017/0129250 A1 May 11, 2017

(30) Foreign Application Priority Data

Nov. 10, 2015 (JP) ..... 2015-220122

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
None
See application file for complete search history.

(56) References Cited

U.S. PATENT DOCUMENTS 9,073,073 B2 7/2015 Miyajima et al.
2014/0218448 A1* 8/2014 Mizutani ..... B41J 2/17513 347/86

FOREIGN PATENT DOCUMENTS

JP 2008-200996 9/2008
JP 2008200996 A * 9/2008
JP 2013-132895 7/2013

* cited by examiner

*Primary Examiner* — Matthew Luu
*Assistant Examiner* — Tracey McMillion
(74) *Attorney, Agent, or Firm* — Workman Nydegger

(57) ABSTRACT

A pressure controlling apparatus includes a seat having a communication hole through which a first space and a second space, in which a liquid flows, are in communication with each other, a pressure receiving plate configured to move with a change in pressure in the second space, a valve member configured to open and close the communication hole in conjunction with the movement of the pressure receiving plate, and a biasing member disposed between the pressure receiving plate and the seat and configured to bias the pressure receiving plate. The biasing member includes a first portion in contact with the pressure receiving plate and a second portion positioned closer than the first portion to the seat. The first portion has a larger diameter than the second portion.

9 Claims, 4 Drawing Sheets

PRESSURE CONTROLLING APPARATUS AND LIQUID EJECTING APPARATUS

BACKGROUND

1. Technical Field

The present invention relates to a structure of a pressure controlling apparatus configured to control a pressure of a liquid stored in a space.

2. Related Art

A liquid in a liquid reservoir (cartridge) is supplied through a channel to a liquid ejecting head configured to eject a liquid such as ink through a plurality of nozzles. A pressure controlling apparatus for controlling a pressure of the liquid supplied from the liquid reservoir to the liquid ejecting head has been developed. JP-A-2008-200996 discloses a valve unit including a valve member disposed between an ink supply chamber and a pressure chamber, a pressure receiving member configured to move with a change in pressure in the pressure chamber, and a negative pressure retention spring configured to bias the pressure receiving member. A shaft of the valve member is disposed in a valve hole in a partition, which separates the pressure chamber and the ink supply chamber, so as to be in contact with the pressure receiving member at the leading end.

SUMMARY

According to the technology disclosed in JP-A-2008-200996, when a negative pressure is generated in the pressure chamber, the pressure receiving member is displaced against the biasing force applied by the negative pressure retention spring. This opens the valve, allowing the ink to flow from the ink supply chamber to the pressure chamber through the valve hole. However, in the configuration disclosed in JP-A-2008-200996, the negative pressure retention spring has a small diameter than the pressure receiving member, leading to a problem in which the pressure retention spring may be buckled by the pressure caused by the displacement of the pressure receiving member.

An advantage of some aspects of the invention is that buckling of a biasing member (spring) configured to bias a pressure receiving plate is reduced.

A pressure controlling apparatus according to a first aspect of the invention includes a seat having a communication hole through which a first space and a second space, in which a liquid flows, are in communication with each other, a pressure receiving plate configured to move with a change in pressure in the second space, a valve member configured to open and close the communication hole in conjunction with the movement of the pressure receiving plate, and a biasing member disposed between the pressure receiving plate and the seat and configured to bias the pressure receiving plate. The biasing member includes a first portion in contact with the pressure receiving plate and a second portion positioned closer than the first portion to the seat. The first portion has a larger diameter than the second portion. In this aspect, the first portion has a larger diameter than the second portion. This configuration reduces the possibility that the biasing member will be buckled by the pressure applied by the moving pressure receiving plate, compared to a configuration in which the biasing member has a constant diameter, which is equal to that of the second portion, over the entire length.

According to a preferable aspect of the invention, the second portion may be positioned at an opposite end of the biasing member from the first portion, and the biasing member may have a diameter gradually decreasing from the first portion to the second portion. In this aspect, the biasing member has a diameter gradually decreasing from the first portion to the second portion. Thus, the structure of the biasing member is simple and the biasing member is readily produced compared to a configuration in which the diameter of the biasing member is increased and decreased over the first portion and the second portion.

According to a preferable aspect of the invention, the first portion may have a diameter larger than a maximum diameter of the valve member. In this aspect, the first portion has a diameter larger than the maximum diameter of the valve member. This configuration improves the stability of the biasing member compared to a configuration in which the first portion has a diameter smaller than the maximum diameter of the valve member.

A pressure controlling apparatus according to a second aspect of the invention includes a seat having a communication hole through which a first space and a second space, in which a liquid flows, are in communication with each other, a pressure receiving plate configured to move with a change in pressure in the second space, a valve member configured to open and close the communication hole in conjunction with the movement of the pressure receiving plate, and a biasing member disposed between the pressure receiving plate and the seat and configured to bias the pressure receiving plate. A portion of the biasing member in contact with the pressure receiving plate has a diameter larger than a maximum diameter of the valve member. In this aspect, the portion of the biasing member in contact with the pressure receiving plate has a diameter larger than the maximum diameter of the valve member. This configuration reduces the possibility that the biasing member will be buckled by the pressure applied by the moving pressure receiving plate compared to a configuration in which the portion of the biasing member in contact with the pressure receiving plate has a diameter smaller than the maximum diameter of the valve member.

According to a preferable aspect of the second aspect, the biasing member may have a constant diameter over an entire length thereof. In this aspect, the biasing member has a constant diameter over the entire length thereof. Thus, the structure of the biasing member is simple and the biasing member is readily produced compared to a configuration in which the diameter of the biasing member is not constant.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
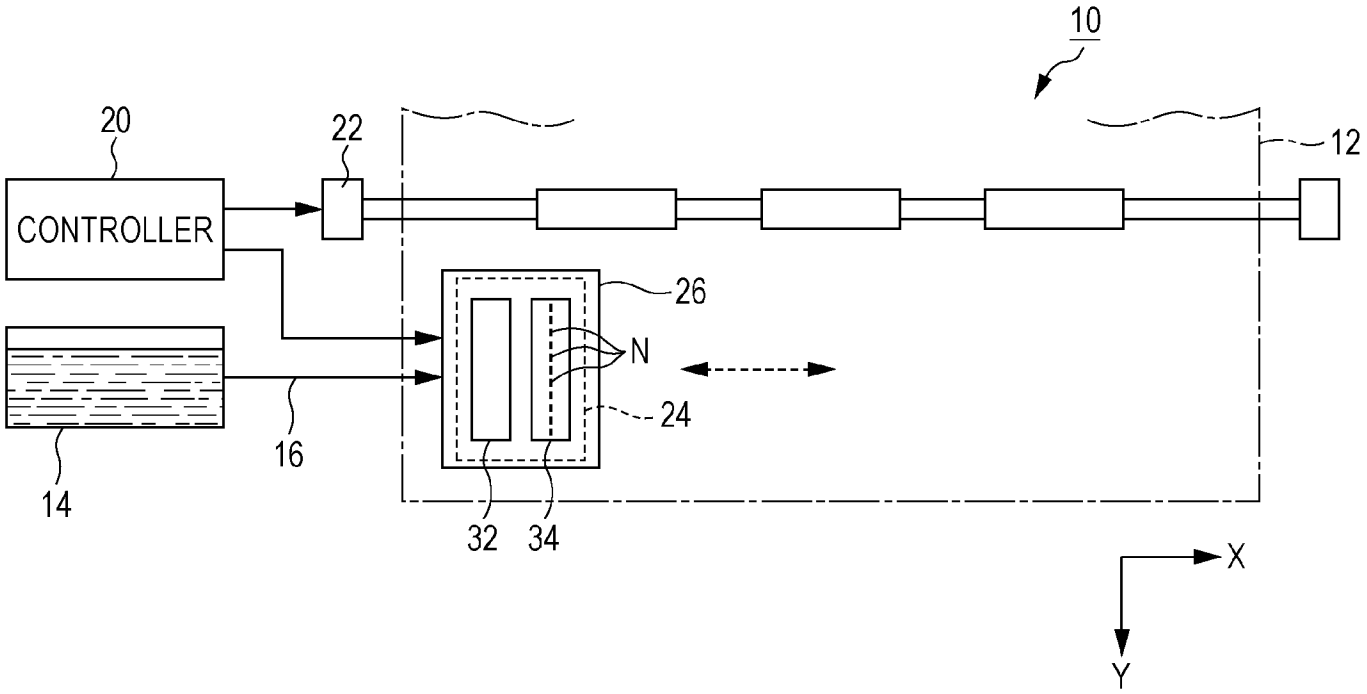
FIG. 1 is a configuration diagram according to a printer of a first embodiment of the invention.

FIG. 1 is a partial configuration diagram of an ink jet printer 10 according to a first embodiment of the invention. The printer 10 in the first embodiment is a liquid ejecting apparatus that ejects ink, which is an example of a liquid, to a medium (target) 12 such as a printing sheet. As illustrated in FIG. 1, the printer 10 includes a controller 20, a transporting mechanism 22, a liquid ejecting unit 24, and a carriage 26. A liquid reservoir (cartridge) 14 that stores the ink is mounted on the printer 10. The ink is supplied from the liquid reservoir 14 to the liquid ejecting unit 24 through a liquid supplying tube 16.

The controller 20 collectively controls each component of the printer 10. The transporting mechanism 22 transports the medium 12 in the Y direction under control of the controller 20.

As illustrated in FIG. 1, the liquid ejecting unit 24 includes a pressure controlling apparatus 32 and a liquid ejecting head 34. The liquid ejecting head 34 ejects the liquid (ink), which has been subjected to pressure control by the pressure controlling apparatus 32, through a plurality of nozzles N to the medium 12 under the control of the controller 20. The liquid ejecting head 34 in the first embodiment includes multiple sets of pressure chambers and piezoelectric elements (not illustrated) provided for corresponding nozzles N. The piezoelectric element is vibrated by application of a driving signal to change the pressure in the pressure chamber, causing the ink in the pressure chamber to be ejected through the nozzle N. The pressure controlling apparatus 32 illustrated in FIG. 1 includes a channel through which the ink, which has been supplied from the liquid reservoir 14 through the liquid supplying tube 16, is supplied to the liquid ejecting head 34.

The liquid ejecting unit 24 is mounted on the carriage 26. The controller 20 reciprocates the carriage 26 in the X direction that intersects the Y direction (at right angles in general). The liquid ejecting head 34 ejects the ink to the medium 12 transported by the transporting mechanism 22 while the carriage 26 is repeatedly reciprocated. As a result, a predetermined image is formed on the medium 12. A plurality of liquid ejecting units 24 that eject different kinds of ink may be mounted on the carriage 26.

Figure 2:
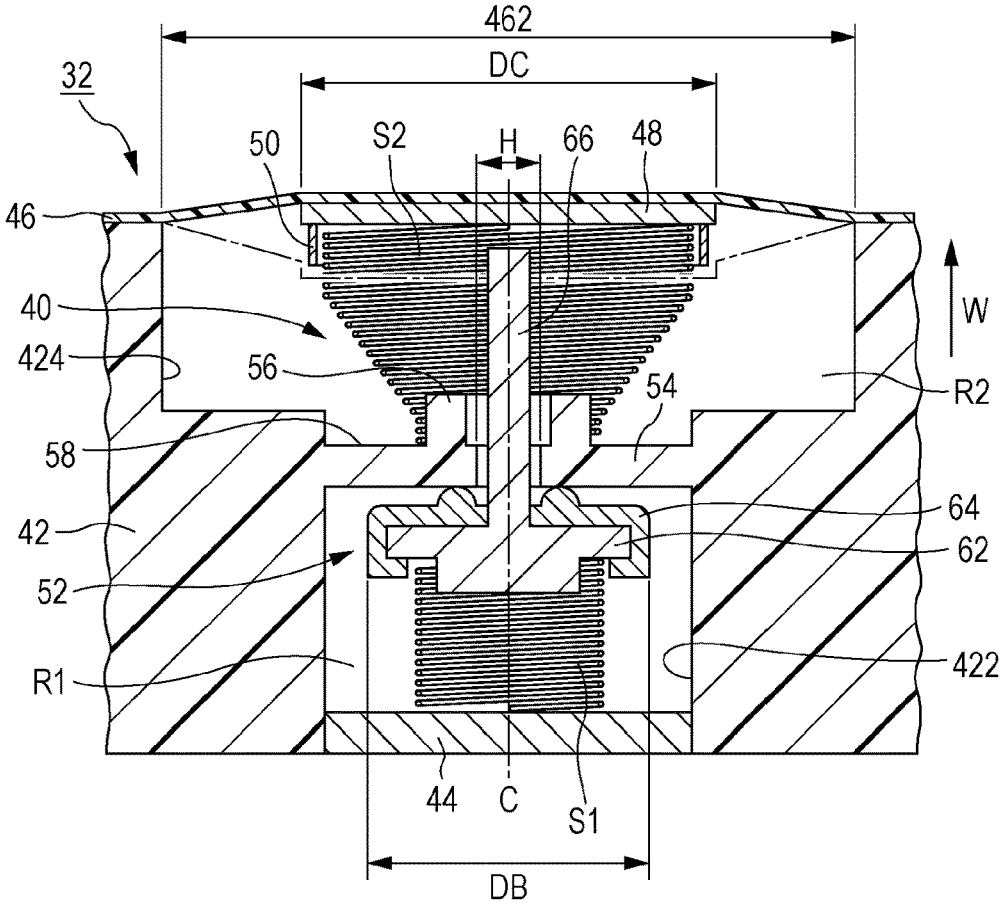
FIG. 2 is a configuration diagram of a valve unit mounted in a pressure controlling apparatus.

The pressure controlling apparatus 32 according to the first embodiment includes a valve unit 40, which is illustrated in FIG. 2, in a channel extending between the liquid supplying tube 16 and the liquid ejecting head 34. The valve unit 40 in the first embodiment is a valve mechanism disposed between a first space R1, which is adjacent to the liquid reservoir 14, and a second space R2, which is adjacent to the liquid ejecting head 34. The valve unit 40 opens and closes (shuts off/opens) the first space R1 depending on the pressure (negative pressure) in the second space R2. Specifically, in a normal state in which the pressure in the second space R2 is within a predetermined range, the valve unit 40 shuts off the first space R1 from the second space R2. If the pressure in the second space R2 is reduced due to ejection of the ink from the liquid ejecting head 34 or suction from an external component, for example, the valve unit 40 enables the first space R1 and the second space R2 to be in communication with each other. The first space R1 and the second space R2 that are in communication with each other allow the ink, which has been supplied to the first space R1 from the liquid reservoir 14 through the liquid supplying tube 16, to flow to the second space R2 through the valve unit 40 and to the liquid ejecting head 34. Specifically, the first space R1 and the second space R2 are positioned upstream and downstream, respectively, of the valve unit 40. A filter that collects bubbles and foreign substances contained in the ink may be disposed upstream of the first space R1 and/or downstream of the second space R2, for example.

As illustrated in FIG. 2, the pressure controlling apparatus 32 in the first embodiment includes a supporting member 42, a sealing member 44, and a sealing member 46. The sealing member 44 is fixed on a surface of the supporting member 42 having a substantially planar shape. The sealing member 46 is fixed on another surface of the supporting member 42. The supporting member 42 may be produced by injection molding a resin material such as polypropylene (PP). The supporting member 42 has a recess (hollow) 422, which opens to the sealing member 44 and has a substantially circular shape in plan view, and a recess 424, which opens to the sealing member 46 and has a substantially circular shape in plan view. A space defined by the recess 422 and the sealing member 44 is the first space R1. A space defined by the recess 424 and the sealing member 46 is the second space R2. The first space R1 is in communication with the liquid supplying tube 16 (or the liquid reservoir 14) directly or indirectly through another component. The second space R2 is in communication with the liquid ejecting head 34 directly or indirectly through another component.

The sealing member 46 is a thin plate (film) formed of a resin material such as polypropylene, which is the same material as the supporting member 42, for example, and is welded or bonded to the surface of the supporting member 42. A pressure receiving plate 48 is disposed on a portion 462 of the sealing member 46 (hereinafter, referred to as a movable portion) on a side adjacent to the supporting member 42 so as to be positioned in the recess 424 in plan view. The pressure receiving plate 48 is a plate having a substantially circular shape, for example, and moves with a change in pressure in the second space R2.

As illustrated in FIG. 2, the valve unit 40 in the first embodiment includes a valve member 52, a seat 54, a biasing member S1, and a biasing member S2. In general, the first space R1 is closed or opened (the first and second spaces R1 and R2 are shut off from or in communication with each other) by moving the valve member 52 toward the positive or negative W direction side of the seat 54. The biasing members S1 and S2 are coil springs composed of spirally wound metal wires, for example.

The seat 54 is a portion of the supporting member 42 positioned between the first space R1 and the second space R2 (a bottom of the recess 422 or 424). The seat 54 faces the movable portion 462 of the sealing member 46 with a distance therebetween. In other words, the seat 54 is a partition separating the first space R1 from the second space R2. As illustrated in FIG. 2, the seat 54 includes a communication hole H at the substantially middle through which the first space R1 and the second space R2 are in communication with each other. The communication hole H in the first embodiment is a precise circular hole having an inner surface extending in the W direction. The first space R1 positioned upstream of the seat 54 and the second space R2 positioned downstream of the seat 54 are in communication with each other through the communication hole H in the seat 54. The seat 54 of the first embodiment includes a tubular portion 56, which protrudes toward the sealing member 46 and surrounds the communication hole H, on a surface adjacent to the sealing member 46.

The valve member 52 of the valve unit 40 is disposed in the first space R1 and opens and closes the communication hole H in conjunction with the movement of the pressure receiving plate 48. As illustrated in FIG. 2, the valve member 52 includes a base 62, a sealing portion (seal) 64, and a valve shaft 66. The base 62 is a planer portion having a circular shape with an outer diameter larger than an inner diameter of the communication hole H. The valve shaft 66 is arranged coaxially with the base 62 and extends from a surface of the base 62 in the vertical direction. The sealing portion 64 having a ring shape surrounding the valve shaft 66 in plan view is disposed on the surface of the base 62. The valve member 52 is arranged such that the base 62 and the sealing portion 64 are positioned in the first space R1 while the valve shaft 66 having an axis C extending in the W direction is disposed in the communication hole H in the seat 54. In other words, the base 62 and the sealing portion 64 of the valve member 52 are positioned on the opposite side of the seat 54 from the movable portion 462 (second space R2). The leading end of the valve shaft 66 in the communication hole H in the seat 54 is in contact with the pressure receiving plate 48, which is disposed on the movable portion 462, in the second space R2. The valve shaft 66 has a diameter smaller than the inner diameter of the communication hole H. Thus, as can be seen from FIG. 2, a space is provided between the inner surface of the communication hole H in the seat 54 and the outer surface of the valve shaft 66. The biasing member S1 in FIG. 2 is disposed between the sealing member 44 and the base 62 of the valve member 52 so as to bias the valve member 52 toward the seat 54.

Figure 3:
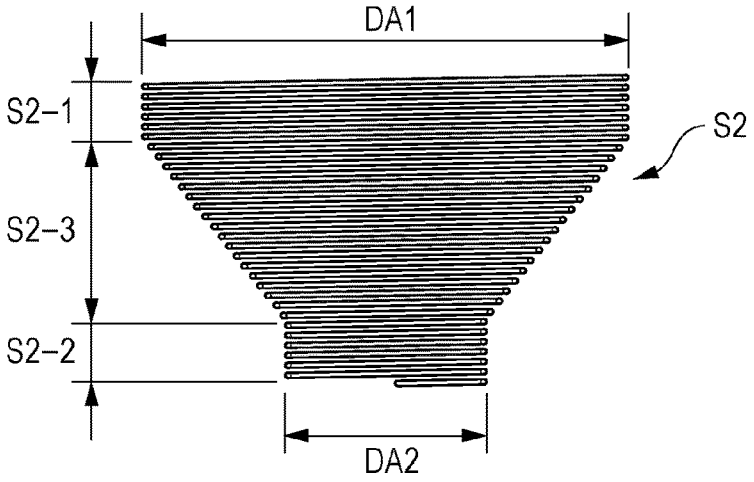
FIG. 3 is a configuration diagram of a biasing member.

The biasing member S2 is disposed between the pressure receiving plate 48 (movable portion 462) and the seat 54 to bias the pressure receiving plate 48. FIG. 3 is a configuration diagram of the biasing member S2. As illustrated in FIG. 3, the biasing member S2 in the first embodiment includes a first portion S2-1, a second portion S2-2, and a third portion S2-3 coaxially connected to each other. The first portion S2-1 has a cylindrical shape and is in contact with the pressure receiving plate 48. The second portion S2-2 has a cylindrical shape and is positioned closer than the first portion S2-1 to the seat 54. In the first embodiment, the second portion S2-2 is positioned at an opposite end of the biasing member S2 from the first portion S2-1. The third portion S2-3 is positioned between the first portion S2-1 and the second portion S2-2. The first portion S2-1, the second portion S2-2, and the third portion S2-3 each may have any length.

As can be seen from FIG. 3, the first portion S2-1 has a diameter DA1 larger than a diameter DA2 of the second portion S2-2. The diameter DA1 is an average diameter of an outer diameter of the first portion S2-1. The diameter DA2 is an average diameter of an outer diameter of the second portion S2-2. In the first embodiment, the diameter DA1 of the first portion S2-1 is substantially constant over the entire length of the first portion S2-1, and the diameter DA2 of the second portion S2-2 is substantially constant over the entire length of the second portion S2-2. In the first embodiment, the diameter DA1 of the first portion S2-1 is larger than a maximum diameter DB of the valve member 52, and the diameter DA2 of the second portion S2-2 is smaller than the maximum diameter DB of the valve member 52. The diameter DA2 of the second portion S2-2 is the smallest diameter of the biasing member S2 over the entire length of the biasing member S2. As illustrated in FIG. 2, the maximum diameter DB of the valve member 52 is the outer diameter of the ring-shaped sealing portion 64 disposed on the base 62.

As illustrated in FIG. 2, the first portion S2-1 is in contact with the surface of the pressure receiving plate 48 (surface opposite to the sealing member 46). A protrusion 50 having a ring shape extends from the surface of the pressure receiving plate 48 toward the seat 54. The first portion S2-1 is positioned in the ring-shaped protrusion 50 and is in contact with the pressure receiving plate 48. The inner diameter of the protrusion 50 is larger than the diameter DA1 of the first portion S2-1. Thus, a space is provided between the inner surface of the protrusion 50 and the outer surface of the first portion S2-1. This configuration enables the first portion S2-1 to be in contact with the surface of the pressure receiving plate 48 even if an error in position of the supporting member 42, which is fixed to the sealing member 46 by welding or bonding, occurs.

The diameter DA2 of the second portion S2-2 is substantially equal to the outer diameter of the tubular portion 56 on the seat 54. Thus, the second portion S2-2 is connected to the tubular portion 56 and the end portion of the biasing member S2 at the side of the second portion S2-2 is in contact with a surface 58 of the seat 54 on which the biasing member S2 is mounted (hereinafter may be referred to as a mounting surface) while the inner surface of the second portion S2-2 is closely in contact with the outer surface of the tubular portion 56. The biasing member S2 is fixed to the seat 54 when the second portion S2-2 is connected to the tubular portion 56.

In the first embodiment, the diameter of the third portion S2-3 gradually decreases from the first portion S2-1 to the second portion S2-2. Specifically, the diameter of the third portion S2-3 decreases from an end of the third portion S2-3 adjacent to the first portion S2-1 to an end of the third portion S2-3 adjacent to the second portion S2-2 at a constant rate. In other words, the third portion S2-3 has a circular truncated conical shape. As described above, the first portion S2-1 and the second portion S2-2 each have any length. The first portion S2-1 and/or the second portion S2-2 may be composed of one winding of the metal wire of the coil spring (biasing member S2), for example. The overall shape of the biasing member S2 including the first portion S2-1, the second portion S2-2, and the third portion S2-3 may be a circular truncated cone.

In the above-described configuration, during a normal state in which the pressure in the second space R2 is maintained in a predetermined range, the biasing member S1 biases the valve member 52 such that the sealing portion 64 is pressed tightly against the surface of the seat 54. Thus, the valve member 52 keeps closing the communication hole H in the seat 54 (hereinafter, this state may be referred to as a closed state). In other words, the first space R1 and the second space R2 are shut off from each other. Meanwhile, if the pressure in the second space R2 decreases due to ejection of the ink through the liquid ejecting head 34 or suction by an external device, for example, the movable portion 462 of the sealing member 46 is displaced toward the seat 54, and the pressure receiving plate 48 on the movable portion 462 presses the valve shaft 66 of the valve member 52 against the biasing force of the biasing member S2. The movable portion 462 functions as a diaphragm that moves with a change in pressure (negative pressure) in the second space R2. When the pressure in the second space R2 further decreases, the valve shaft 66 is pressed by the movable portion 462 (pressure receiving plate 48), and the valve member 52 moves toward the negative W direction side (toward the sealing member 44) against the biasing force of the biasing member S1. Thus, the sealing portion 64 is positioned away from the seat 54 (hereinafter, this state may be referred to as an open state). In the open state, the communication hole H in the seat 54 is open, allowing the first space R1 and the second space R2 to be in communication with each other through the communication hole H. As can be understood from this, the valve member 52 allows the first space R1 and the second space R2 to be shut off from or in communication with each other (allows or does not allow ink to pass therethrough) in conjunction with the displacement of the sealing member 46 (movable portion 462).

If the biasing member S2 has a small diameter over the entire length (diameter smaller than the maximum diameter DB of the valve member 52, for example) (hereinafter, this configuration may be referred to as a comparative example), the biasing member S2 may be buckled by the pressure applied by the pressure receiving plate 48. If the biasing member S2 is buckled, the pressure receiving plate 48 and the valve member 52 (valve shaft 66) are titled with respect to the W direction. In such a configuration, an area of the space between the inner surface of the communication hole H and the outer surface of the valve shaft 66 of the valve member 52 (channel resistance) may vary compared to the case in which the valve member 52 is expected to move in the W direction without buckling of the biasing member S2. If the channel resistance in the communication hole H varies as described above, the negative pressure in the second space R2 varies when the communication hole H is opened or closed. This may cause an error in the pressure of the ink supplied from the second space R2 to the liquid ejecting head 34, leading to an error in the amount of the ink ejected through the liquid ejecting head 34 (size of dots).

Contrary to the comparative example, in the first embodiment, the diameter DA1 of the first portion S2-1 of the biasing member S2 is larger than the diameter DA2 of the second portion S2-2. This reduces the possibility that the biasing member S2 will be buckled by the pressure applied by the moving pressure receiving plate 48 compared to a comparative example in which the biasing member S2 has a constant diameter, which is substantially equal to the diameter DA2 of the second portion S2-2, over its entire length. Since the reduction in the buckling of the biasing member S2 prevents the channel resistance of the communication hole H from varying, the error in pressure in the second space R2, which may occur when the communication hole H is opened or closed, is reduced, leading to a reduction in error in the amount of ink ejected through the liquid ejecting head 34.

In the first embodiment particularly, the diameter of the biasing member S2 gradually decreases from the first portion S2-1 to the second portion S2-2. Thus, the biasing member S2 has a simple structure and the biasing member S2 is readily produced compared to a configuration in which the diameter of a biasing member S2 is increased and decreased over the first portion S2-1 and the second portion S2-2. In addition, since the diameter DA1 of the first portion S2-1 is larger than the maximum diameter DB of the valve member 52, the biasing member S2 has higher stability than a configuration in which the diameter DA1 of the first portion S2-1 is smaller than the maximum diameter DB of the valve member 52.

Second Embodiment

A second embodiment of the invention is described. Components of the second embodiment described below that are the same as those of the first embodiment in operation and function are assigned the same reference numerals as those in the first embodiment, and a detailed description thereof may be omitted.

Figure 4:
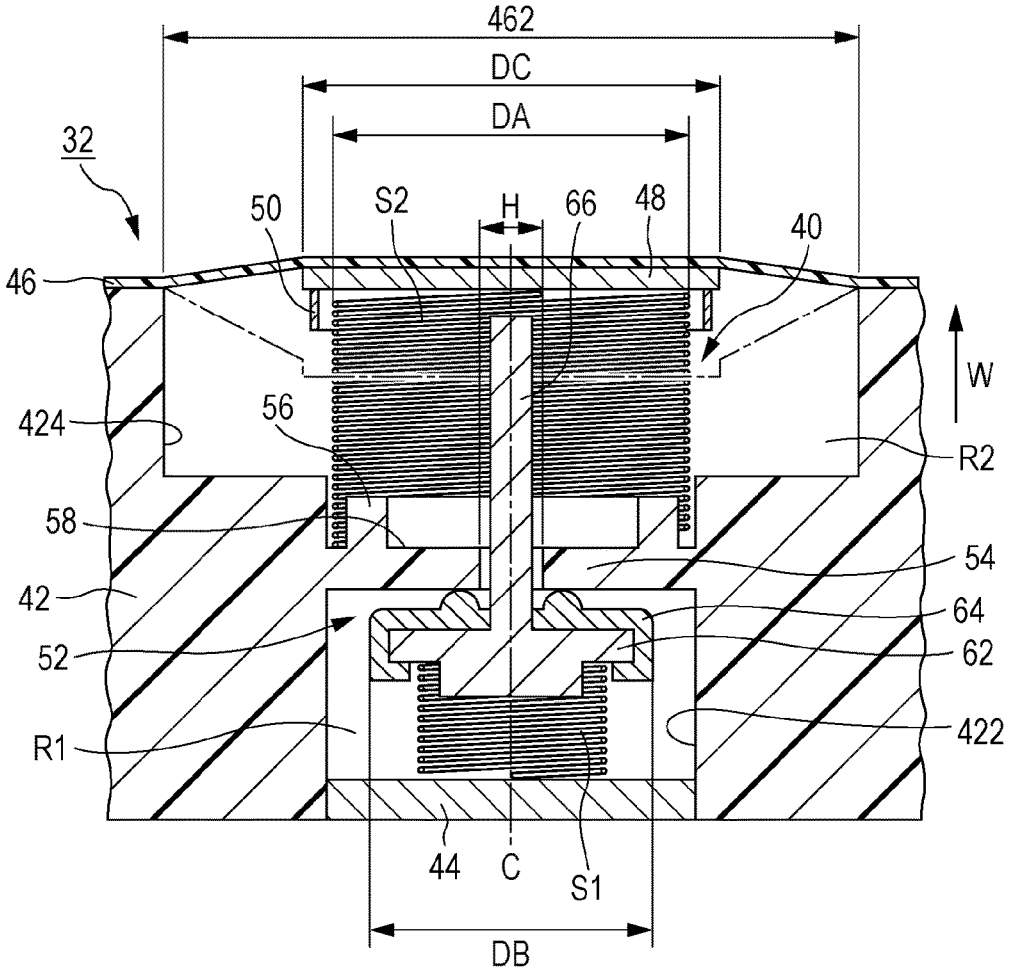
FIG. 4 is a configuration diagram of a valve unit mounted in a pressure controlling apparatus according to a second embodiment.

FIG. 4 is a configuration diagram of a valve unit 40 mounted in a pressure controlling apparatus 32 in the second embodiment. As illustrated in FIG. 4, a biasing member S2 in the second embodiment has a cylindrical shape having a substantially constant diameter DA over the entire length. The diameter DA is an average diameter of an outer diameter of the biasing member S2. As can be seen from FIG. 4, the diameter DA of the biasing member S2 is larger than the maximum diameter DB of the valve member 52. In addition, a diameter DC of the pressure receiving plate 48 biased by the biasing member S2 is larger than the maximum diameter DB of the valve member 52. As in the first embodiment, the maximum diameter DB of the valve member 52 is an outer diameter of the ring-shaped sealing member 64 mounted on the base 62.

If the biasing members S2 (coil springs) in the first embodiment and the second embodiment are identical in the number of windings, the spring constant of the biasing member S2 in the second embodiment is smaller than the spring constant of the biasing member S2 in the first embodiment. In the second embodiment, the entire length of the biasing member S2 is made longer than that of the biasing member S2 in the first embodiment such that the movement amount of the valve shaft 66 in the first embodiment and that in the second embodiment are substantially equal when the pressure in the second space R2 in the first embodiment and that in the second embodiment are substantially equal. Specifically, as illustrated in FIG. 4, the mounting surface 58 of the seat 54 in the second embodiment is positioned close to the sealing member 44 compared to that in the first embodiment such that the entire length of the biasing member S2 in the second embodiment is accommodated. As can be understood from the above explanation, the entire length of the biasing member S2 and the position of the mounting surface 58 of the seat 54 are suitably adjusted depending on the spring constant of the biasing member S2. In addition, the outer diameter of the tubular portion 56 in the second embodiment is larger than that in the first embodiment. The outer diameter of the tubular portion 56 is also suitably adjusted depending on the diameter DA of the biasing member S2.

In the above-described configuration, the diameter DA of the portion of the biasing member S2 in contact with the pressure receiving plate 48 is larger than the maximum diameter DB of the valve member 52. This configuration reduces the possibility that the biasing member S2 will be buckled by the pressure applied by the moving pressure receiving plate 48 compared to a configuration in which the diameter DA of the portion of the biasing member S2 in contact with the pressure receiving plate 48 is smaller than the maximum diameter DB of the valve member 52. In particular, in the second embodiment, since the diameter DA of the biasing member S2 is constant over the entire length of the biasing member S2, the structure of the biasing member S2 is simple and the biasing member S2 is readily produced compared to a configuration in which the diameter DA of the biasing member S2 is not constant.

Modifications

The above-described embodiments may be modified in various ways. Examples of modifications are described in detail below. Any two or more of the following features may be combined unless the combination causes any inconsistency.

(1) In the first embodiment, the second portion S2-2 is positioned at the opposite end of the biasing member S2 from the first portion S2-1, but the position of the second portion S2-2 is not limited to this example. The second portion S2-2 may be positioned at a middle of the biasing member S2 in the axial direction, for example. As can be understood from this, the second portion S2-2 is broadly defined as a portion of the biasing member S2 positioned closer than the first portion S2-1 to the seat 54.

(2) In the first embodiment, the diameter DA2 of the second portion S2-2 of the biasing member S2 is substantially equal to the outer diameter of the tubular portion 56 mounted on the seat 54, but the diameter DA2 of the second portion S2-2 is not limited to this example. For example, if the second portion S2-2 is positioned at a middle of the biasing member S2, the diameter DA2 is not necessarily equal to the outer diameter of the tubular portion 56 since the second portion S2-2 is not connected to the tubular portion 56.

Figure 5:
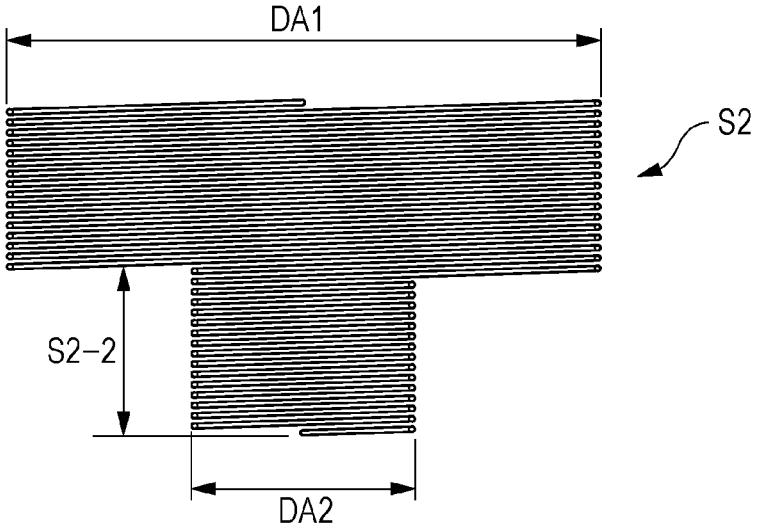
FIG. 5 is a configuration diagram of a biasing member according to a modification.
Figure 6:
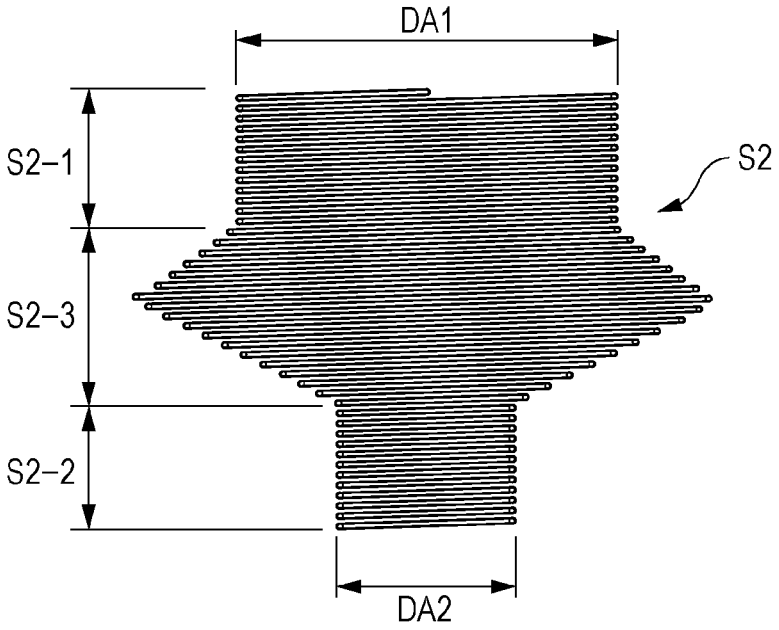
FIG. 6 is a configuration diagram of a biasing member according to a modification.

(3) The shape of the biasing member S2 is not limited to the shapes exemplified in the first and second embodiments. In the first embodiment, for example, the third portion S2-3 of the biasing member S2 has a circular truncated conical shape having a diameter gradually decreasing from the first portion S2-1 to the second portion S2-2, but the shape of the third portion S2-3 is not limited to this example. As illustrated in FIG. 5, the third portion S2-3 may be eliminated, for example. In other words, the biasing member S2 may have a diameter varied in a discontinuous manner or in stages. Alternatively, as illustrated in FIG. 6, the third portion S2-3 may have a diameter gradually increasing and decreasing. As can be understood from the above description, the third portion S2-3 may be present or absent, and may have any shape.

(4) The diameter DA1 of the first portion S2-1 of the biasing member S2 is larger than the maximum diameter DB of the valve member 52 in the first embodiment, and the diameter DA of the entire biasing member S2 is larger than the maximum diameter DB of the valve member 52 in the second embodiment. The configurations of the first embodiment and the second embodiment are broadly defined as a configuration in which a portion of the biasing member S2 in contact with the pressure receiving plate 48 has a diameter (DA1, DA) larger than the maximum diameter DB of the valve member 52 (hereinafter, may be referred to as Configuration A). However, Configuration A is not essential to the configuration of the first embodiment in which the diameter DA1 of the first portion S2-1 is larger than the diameter DA2 of the second portion S2-2. In other words, in the first embodiment, the diameter DA1 of the first portion S2-1 may be smaller than the maximum diameter DB of the valve member 52.

(5) In the above-described embodiments, the movable portion 462 has the thin plate (film) like shape. However, the movable portion 462 may have any configuration. The movable portion 462 may be formed of an elastic material so as to be elastically deformed depending on the pressure in the second space R2, or may have an expandable structure such as a bellows structure so as to be deformed depending on the pressure in the second space R2. As can be understood from this, the flexibility of the movable portion 462 is an optional feature to the invention.

(6) In the above-described embodiments, the valve member 52 moves relative to the seat 54. However, the seat 54 may move relative to the valve member 52. As can be understood from this, any one of the valve member 52 and the seat 54 may move in the invention as long as the relative movement between the seat 54 and the valve member 52 is caused during the closed state.

(7) In the above-described embodiments, the configuration according to the invention is applied to a serial head in which the carriage 26 having the liquid ejecting unit 24 thereon repeatedly reciprocates in the X direction. However, the invention is also applicable to a line head including a plurality of nozzles N arranged in the X direction over the entire width of the medium 12. In addition, a driving element that allows the ink to be ejected through the nozzles N of the liquid ejecting head 34 is not limited to the piezoelectric element exemplified in the above-described embodiments. The driving element may be a heating element (heater) that generates a bubble by heating and varies pressure in a pressure chamber such that the ink is ejected through the nozzles N.

(8) The printer 10 described in the above-described embodiments may be used in a print-only printer, or any apparatus such as a facsimile machine and a copier. However, the application of the liquid ejecting apparatus of the invention is not limited to the printer. The liquid ejecting apparatus that ejects a colored solution may be used as an apparatus for producing a colored filter of a liquid display, for example. The liquid ejecting apparatus that ejects a solution of a conductive material may be used as an apparatus for forming a wire or an electrode of a wiring substrate.

The entire disclosure of Japanese Patent Application No. 2015-220122, filed Nov. 10, 2015 is expressly incorporated by reference herein.

What is claimed is:

1. A pressure controlling apparatus comprising:

a seat having a communication hole through which a first space and a second space, in which a liquid flows, are in communication with each other;

a pressure receiving plate configured to move with a change in pressure in the second space;

a valve member configured to open and close the communication hole in conjunction with the movement of the pressure receiving plate; and a biasing member disposed between the pressure receiving plate and the seat and configured to bias the pressure receiving plate, wherein the biasing member includes a first portion in contact with the pressure receiving plate and a second portion positioned closer than the first portion to the seat, the first portion having a larger diameter than the second portion, and wherein, when a straight line is drawn between a center of the biasing member and a farthest edge of the pressure receiving plate from the center of the biasing member, a contact point of the biasing member and the pressure receiving plate is closer to the farthest edge of the pressure receiving plate than the center of the biasing member, where the contact point of the biasing member and the pressure receiving plate are located on the straight line.

2. The pressure controlling apparatus according to claim 1, wherein the second portion is positioned at an opposite end of the biasing member from the first portion, and the biasing member has a diameter gradually decreasing from the first portion to the second portion.

3. The pressure controlling apparatus according to claim 1, wherein the first portion has a diameter larger than a maximum dimeter of the valve member.

4. A liquid ejecting apparatus comprising:

the pressure controlling apparatus according to claim 1; and a liquid ejecting head configured to eject a liquid which has been subjected to pressure control by the pressure controlling apparatus.

5. A pressure controlling apparatus comprising:

a seat having a communication hole through which a first space and a second space, in which a liquid flows, are in communication with each other;

a pressure receiving plate configured to move with a change in pressure in the second space;

a valve member configured to open and close the communication hole in conjunction with the movement of the pressure receiving plate; and a biasing member disposed between the pressure receiving plate and the seat and configured to bias the pressure receiving plate, wherein a portion of the biasing member in contact with the pressure receiving portion has a diameter larger than a maximum diameter of the valve member, and wherein, when a straight line is drawn between a center of the biasing member and a farthest edge of the pressure receiving plate from the center of the biasing member, a contact point of the biasing member and the pressure receiving plate is closer to the farthest edge of the pressure receiving plate than the center of the biasing member, where the contact point of the biasing member and the pressure receiving plate are located on the straight line.

6. The pressure controlling apparatus according to claim 5, wherein the biasing member has a constant diameter over an entire length thereof.

7. A liquid ejecting apparatus comprising:

the pressure controlling apparatus according to claim 5; and a liquid ejecting head configured to eject a liquid which has been subjected to pressure control by the pressure controlling apparatus.

8. A pressure controlling apparatus comprising:

a seat having a communication hole through which a first space and a second space, in which a liquid flows, are in communication with each other;

a pressure receiving plate configured to move with a change in pressure in the second space;

a valve member configured to open and close the communication hole in conjunction with the movement of the pressure receiving plate; and a biasing member disposed between the pressure receiving plate and the seat and configured to bias the pressure receiving plate, wherein, when a straight line is drawn between a center of the biasing member and a farthest edge of the pressure receiving plate from the center of the biasing member, a contact point of the biasing member and the pressure receiving plate is closer to the farthest edge of the pressure receiving plate than the center of the biasing member, where the contact point of the biasing member and pressure receiving plate is located on the straight line.

9. A liquid ejecting apparatus comprising:

the pressure controlling apparatus according to claim 8; and a liquid ejecting head configured to eject a liquid which has been subjected to pressure control by the pressure controlling apparatus.

* * * * *